US005551485A

United States Patent [19]

Faulkner

[11] Patent Number: 5,551,485

[45] Date of Patent: Sep. 3, 1996

[54] FALSE WARP STOP DIAGNOSTIC APPARATUS

[76] Inventor: John V. Faulkner, 7217 Kirkwood Dr., Columbus, Ga. 31904

[21] Appl. No.: 315,393

[22] Filed: Sep. 30, 1994

[51] Int. Cl.[6] ..... D03D 51/30

[52] U.S. Cl. ..... 139/353; 327/20; 200/61.18; 340/651

[58] Field of Search ..... 327/20; 200/61.18; 340/651; 139/353; 66/163; 28/186–189

[56] References Cited

U.S. PATENT DOCUMENTS 3,343,158 9/1967 Tellerman ..... 66/163
3,725,911 4/1973 Cook et al. ..... 139/353 X
3,943,409 3/1976 Brown ..... 340/651
3,952,554 4/1976 Kerff ..... 66/163

*Primary Examiner*—Andy Falik
*Attorney, Agent, or Firm*—Jones & Askew

[57] ABSTRACT

A diagnostic device for testing a false warp stop in an industrial loom caused by a failing or offending drop wire. The device provides a connector that is operably engaged with the warp bars of an industrial loom. When a drop wire becomes worn or pliable and bridges the warp bar to stop the loom, the connector assists to create a circuit that includes the affected warp bar, a power source, a rectifier and an indicator device. The indicator device is activated by completion of the circuit and remains actuated even after the loom is restarted. The apparatus is thus effective to help locate a failing drop wire as opposed to a drop wire that has fallen due to a slack or broken warp thread.

3 Claims, 5 Drawing Sheets

FALSE WARP STOP DIAGNOSTIC APPARATUS

FIELD OF THE INVENTION

The present invention relates generally to industrial weaving looms and their operation. More particularly, the present invention relates to identifying a faulty loom component that is causing the loom needlessly to stop operation.

BACKGROUND OF THE INVENTION

Industrial air-jet looms are complicated pieces of equipment. Such looms weave thousands of threads to create a desired fabric. As a result, an industrial loom has many intricate parts that must operate in conjunction one with another to create the resulting fabric.

In order to accomplish this result, industrial looms perform certain operations. For example, such looms engage in a shedding operation whereby the longitudinal or warp threads are divided or opened, a picking operation whereby the weft thread is inserted between the divided warp, and a beating operating whereby the reed strikes the weft thread into position in the fabric. The warp threads travel through the loom under a certain tension. During the performance of any of the above-described operations, it is known that a warp thread may break or slacken. In such an event, the thread is either omitted or mis-woven to such an extent that the resulting fabric is unacceptable. The prior art has recognized this problem and provided devices that detect warp yarn breaks or slacking. Once detected, the loom is stopped to facilitate repair of the thread.

Described more particularly, it is known to provide an industrial loom with electrically conducting metal elements that extend in a direction parallel with the weft thread. The metal elements extend the entire width of the fabric and are positioned over the warp. A plurality of drop wires, one for each of the thousands of threads, are positioned over and about the metal elements. As there may be thousands of threads, these are also thousands of corresponding drop wires closely aligned along the length of the metal elements. The drop wires are supported in position by warp threads. If a warp thread breaks, the drop wire supported by that thread falls gravitationally onto one of the electrically charged metal elements. The drop wire bridges or short-circuits that metal element and completes an electrical connection for stopping the loom. Once the loom has stopped, the operator checks the loom to determine which thread had broken, effects repair of that thread and restarts the loom.

It can be difficult for the operator to determine which drop wire has fallen. In some cases, the operator may not be able to see the fallen drop wire and need to run his or her hand over all of the drop wires in a "hunt-and-peck" like fashion to locate the one that has fallen. Various devices have been proposed to assist the operator in this effort. For example, U.S. Pat. No. 3,725,911 discloses a stop motion device with a selective indicator for a multi-threaded textile machine. The device includes a number of thread slack-detection switches, each having an indicator lamp. A four-layer diode is provided to complete a circuit and thereby stop the motion of the loom machine and to light the relevant indicator lamp. In this fashion, the machine operator is appraised of which thread affected stoppage of the machine.

Another such device is shown in U.S. Pat. No. 4,321,951 to Hintsch, which discloses a warp yarn stop motion device. This patent describes a sub-divided locating rail connected with pilot lights at the end of each section. Should a drop wire fall onto a rail section, the pilot lights at the end of that section are illuminated to identify the section of the rail within which a broken warp thread is located.

As indicated above, the drop wires are supported by the warp threads. These threads travel through the loom, under tension, at significant speed. The drop wires are preferably of a lightweight material that will not gravitationally displace the thread due to its own weight. As each thread is provided with a drop wire, the drop wires must also be relatively thin in dimension. As a result of these structural considerations and due to the action of the thread passing therethrough, the drop wires become worn and pliable. The drop wires seemingly "dance" about the metal elements and, once sufficiently worn and pliable, will twist or otherwise contact a metal element even though the supporting thread is neither broken nor slack. Nevertheless, the loom will stop automatically because contact of the drop wire and the electrically-charged metal element will bridge or short-circuit the element and complete the electrical connection for stopping the loom. This condition is referred to as a "false warp stop."

In the event of a false warp stop, the operator must search for the offending drop wire. However, once the loom stops, the offending drop wire typically returns to its initial position and will appear to be in good working order. The operator will restart the machine, but the offending drop wire will inevitably twist again and stop the loom. Upon restarting the machine, any indicator lamp that may have been illuminated will be turned off automatically. The indicator lamp will not be activated again until the drop wire touches the metal element, either due to a broken or slackened thread, or due to a false warp stop. It is to be understood that, in many commercial weaving facilities, one operator will be responsible for many looms. To find an offending drop wire that has caused a false warp stop, the operator will restart the loom, causing any indicator lamp to be switched off. Thus, while the operator's attention may be necessarily directed to other looms, any initial indication of the location of the offending wire is readily forgotten. The operator typically requires such additional indication in order to search for a fallen drop wire, let alone an offending drop wire causing false warp stops. Thus, the operator may have to watch and wait for that one machine until the offending wire causes another false warp stop. Such a process is indefinite, time consuming, impractical, and many times impossible.

When an industrial loom machine experiences repeated false warp stops, the efficiency of the weaving process suffers significantly. It is not uncommon for several operators to work together in order to identify the failing or offending drop wire. In such cases, cost of effecting the repair is increased further due to the manpower needed to identify the offending drop wire and the downtime experienced while the operator or operators search for the offending drop wire.

Thus, there is a need in the prior art for a device that assists in the identification and detection of an offending drop wire so as to save loom downtime and repair costs.

SUMMARY OF THE INVENTION

The present invention solves the above-described problems in the prior art by providing a false warp stop diagnostic apparatus that assists in the identification and detection of a drop wire that is causing a false warp stop.

Generally described, the false warp stop diagnostic apparatus of the present invention is for use with an industrial loom with at least one electrically-conducting warp bar and a plurality of associated drop wires, and comprises a connector suitable for operative engagement with the warp bar, a source of electrical energy for injecting a current, a plurality of rectifiers connected in parallel between a pair of junctions, any one of which rectifiers may be fired in response to a short-circuit of said warp bar caused by contact of one of the drop wires with the warp bar, and an indicator device connected in series with each of said rectifiers, whereby an injection of current into the gate fires the rectifier and the indicator device is activated indicating that the warp bar has experienced a false warp stop.

The preferred embodiment of the present invention further provides a reset switch in series with the rectifiers such that operation of said reset switch returns said rectifier to a "no current" status and deactivates the indicator device. Thus, the rectifier is deactivated only when the reset switch is operated. Accordingly, the indicator device is likewise deactivated only when the reset switch is activated.

It will be appreciated by those of ordinary skill in the art that industrial looms often are configured in sections, typically six, reflected in the number of metal elements or warp bars. The preferred embodiment of the present invention is readily adaptable to such a configuration, as the connector may be configured accordingly and a corresponding number of rectifiers and indicator devices may be likewise provided.

In use, an offending drop wire causes a false warp stop on a warp bar. The loom is stopped. The warp bar connector, having been placed in operative engagement with the warp bars, provides an electrical connection with the rectifiers and indicator devices. A current is induced in a circuit including the subject warp bar experiencing the false warp bar stop, and as a result, current is injected into the gate so as to fire the rectifier associated with that warp bar. The indicator device associated with that warp bar is activated. The operator can restart the loom. Even so, the indicator device remains activated. The operator can then inspect that warp bar indicated by the indicator device to determine which drop wire is causing the false wrap stop. In this manner, the preferred embodiment of the present invention assists in the quick identification of the offending drop bar. The repair can be made in a significantly reduced time period, with significant savings in loom downtime and repair costs.

Thus, it is an object of the present invention to provide a diagnostic testing device for a false warp stop.

It is a further object of the present invention to provide a diagnostic testing device that assists in identifying an offending drop wire that causes a false warp stop.

It is a further object of the present invention to provide a false warp stop diagnostic device that is also effective to sense a fallen drop wire resulting from a broken or slack warp thread.

It is a further object of the present invention to provide a false warp stop diagnostic device that improves the efficiency of an industrial loom.

Other objects, features and advantages of the present invention will become apparent from reading the following specification when taken in conjunction with the accompanying drawing.

DETAILED DESCRIPTION

Figure 1:
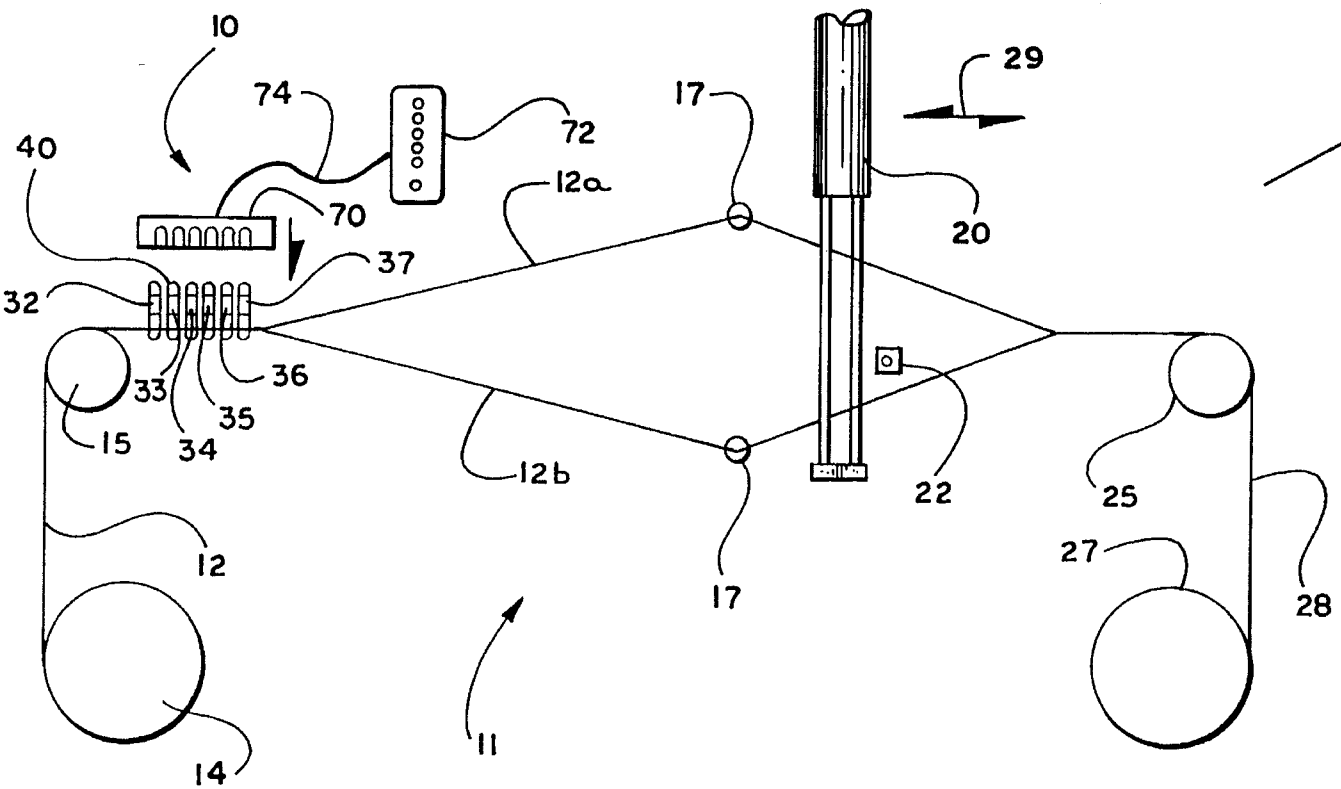
FIG. 1 is a schematic side view of an industrial loom, including warp bars and drop wires.
Figure 2:
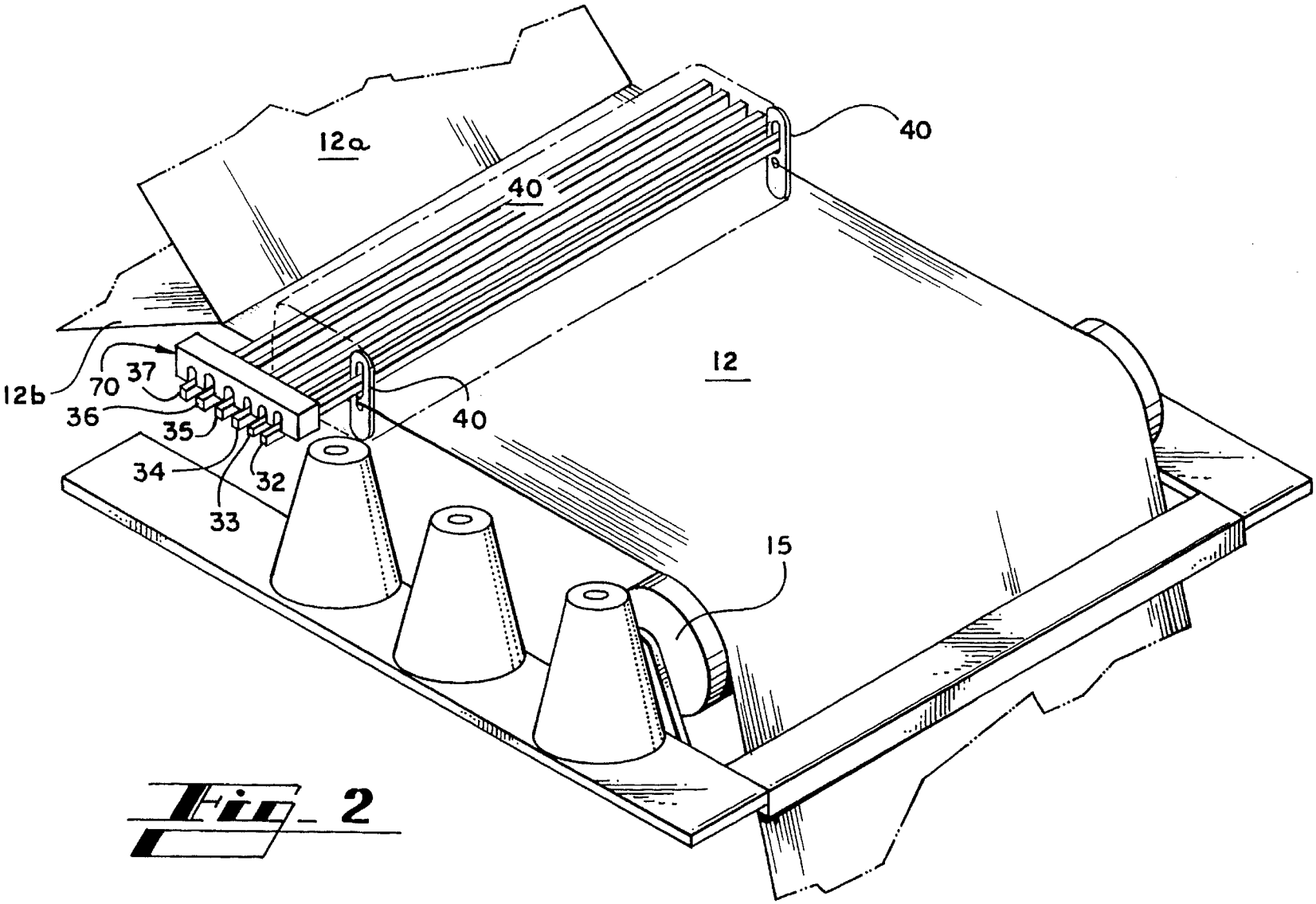
FIG. 2 is a perspective view showing the front or forward portion of an industrial loom fitted with a connector in accordance with the preferred embodiment of the present invention.

Referring now in more detail to the drawing, in which like numerals indicate like parts throughout the several views, FIG. 1 shows a schematic of a preferred embodiment of the present invention at 10 and a side view of an industrial loom, generally indicated at 11. The longitudinal warp threads or beam 12 are wrapped about a roller 14. The warp threads travel over a back roller 15, through the eyes of heddles 17, through the interces of a reed 20, past the shuttle valve 22, over the breast beam 25 to a fabric take-up roller 27. Thus, the resulting fabric 28 is created and wound about the take-up roller 27.

FIG. 1 shows an "open shed" arrangement, where individual warp threads shown representatively at 12*a* and 12*b* are divided by the action of the heddles 17. Once the warp threads 12*a* and 12*b* are separated by the heddles 17, the weft thread (not shown) is inserted therethrough by the shuttle valve 22 in a direction substantially perpendicular to the longitudinal warp threads 12. Once the weft thread has been inserted between the warp threads 12*a* and 12*b*, the heddles 17 are horizontally realized to close the shed. The weft thread is beaten into place by the reed 20. More specifically, the reed 20 provides a comb-like device that travels back and forth as represented by the arrows 29. It will be appreciated by one of ordinary skill that the foregoing operations of an industrial loom 11 are well known and need not be described further herein for purposes of the present invention.

Figure 3:
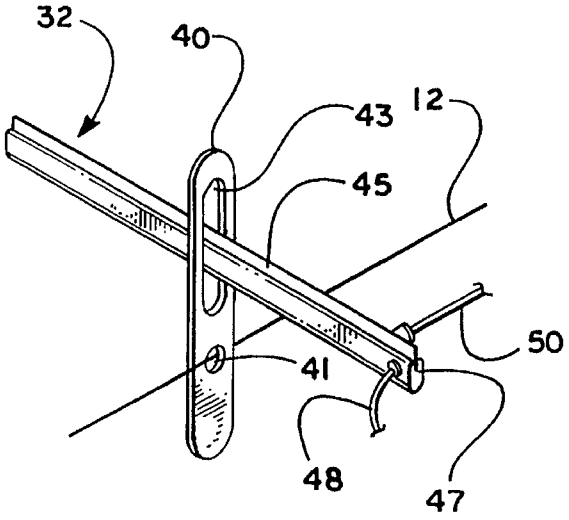
FIG. 3 is a perspective view of a drop wire and warp bar as shown in FIG. 1.

FIG. 1 also shows a plurality of metal elements or warp bars 32–37. Each warp thread 12 is threaded through a drop wire 40 as described herein. Each drop wire 40 is provided with an opening 41 through which the warp thread 12 is passed. By means of the tension in the thread 12, the drop wire 40 is held in the inoperative, elevated position shown in FIG. 3. FIG. 3 shows an isolation warp bar 32 and a single drop wire 40. The drop wire 40 includes a slot 43 through which the warp bar 32–37 projects so that the drop wire slot 43 is centered generally with respect thereto when in the elevated, inoperative position. The warp bars 32-37 conventionally provide an electrically conducting portion 45 that is mounted in a contact portion 47 in the warp bars so as to be electrically insulated therefrom. The details of such a mounting are well known to one of ordinary skill in the art. When the drop wire 40 drops due to a slack or broken thread 12, the electrically conducting portion 45 of the warp bars 32–37 and the contact portion 47 of the warp bar 32–37 is bridged. Suitable conductors 48 and 50 are electrically connected to the warp bars 32–37 as shown in FIG. 3.

Figure 4:
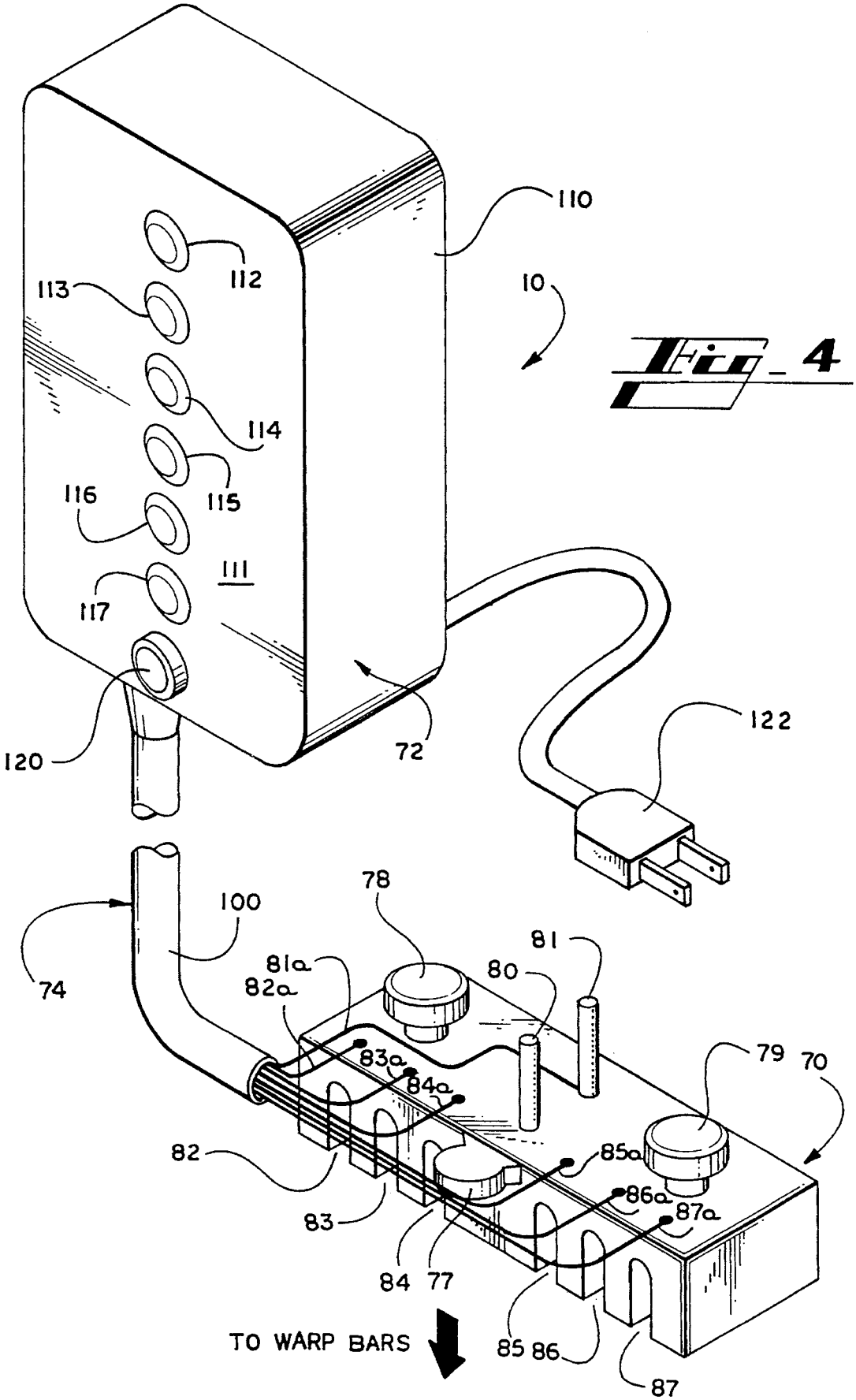
FIG. 4 is a schematic view of a connector and display housing embodying the present invention.

FIG. 4 shows a preferred embodiment of the present invention generally at 10. It is to be appreciated that while this embodiment is shown separate and apart from a loom 11, an alternative embodiment could be provided that is integral with the loom 11.

The embodiment of the false warp stop diagnostic apparatus shown in FIG. 4 includes a connector 70, a display 72 and a connector wire 74. The connector 70 provides a housing 75 that defines a plurality of slots 82–87. The slots are configured for mating receipt of the warp bars 32–37, respectively. The connector may be made of any suitable material, including plastic or steel. It is to be understood that the connector 70 is to be positioned over the warp bars 32–37 at one end thereof so that the connector does not interfere with the operation of the drop wires 40 or the warp threads 12. The connector 70 is therefore preferably rectangular in shape, of sufficient length to extend over all of the warp bars 32–37 and of such width as to not interfere with operation of the loom 11. A mounting bracket 77 is provided to permit the connector 70 to be retrofit to a loom 11. The connector is fitted with two mounting knobs 78 and 79 to further facilitate attachment to the loom 11. The connector 70 is also of sufficient depth to insure electrical and mechanical contact with the warp bars 32–37 within the slots 82–87. The connector includes contact points on its top side having wires 82*a*–87*a* connected thereto, respectively, that are joined together with wire 81*a* to form a connecting wire 100.

Figure 5:
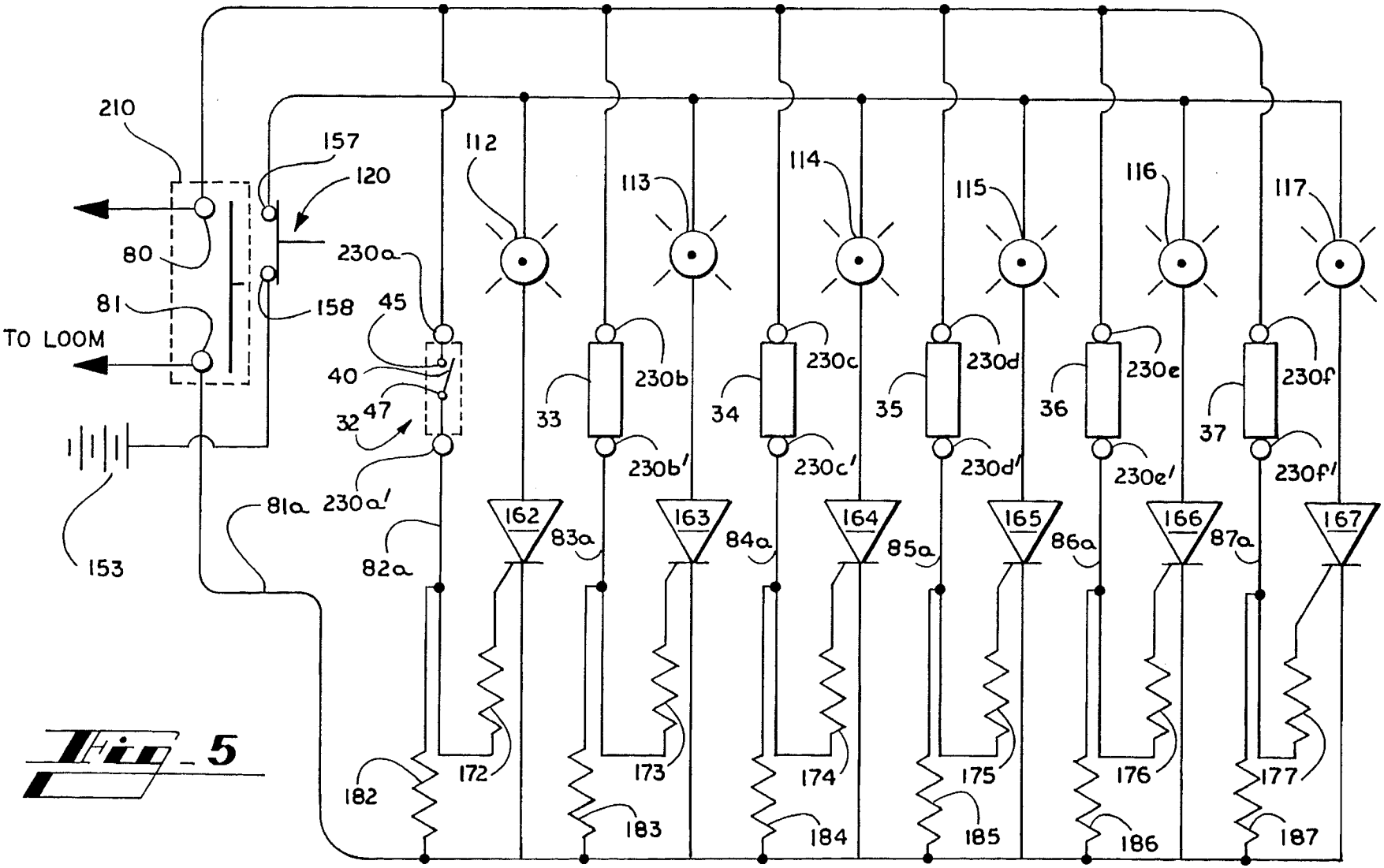
FIG. 5 is a schematic view of a current diagram of the embodiment shown in FIG. 4.

FIG. 4 further shows a display 72 that includes a housing 110 with a front side 111. The front side 111 is fitted with a plurality of display lights 112–117. The display lights 112–117 are electrically connected to correspond to the warp bars 32–37, respectively, as described hereinbelow and shown in the drawings. The display housing 110 further includes a reset button 120 on the front face 111. The reset button is also electrically connected as shown in FIG. 5 and described hereinbelow. Further, a power cord 122 that may be utilized as described below.

Figure 6A:
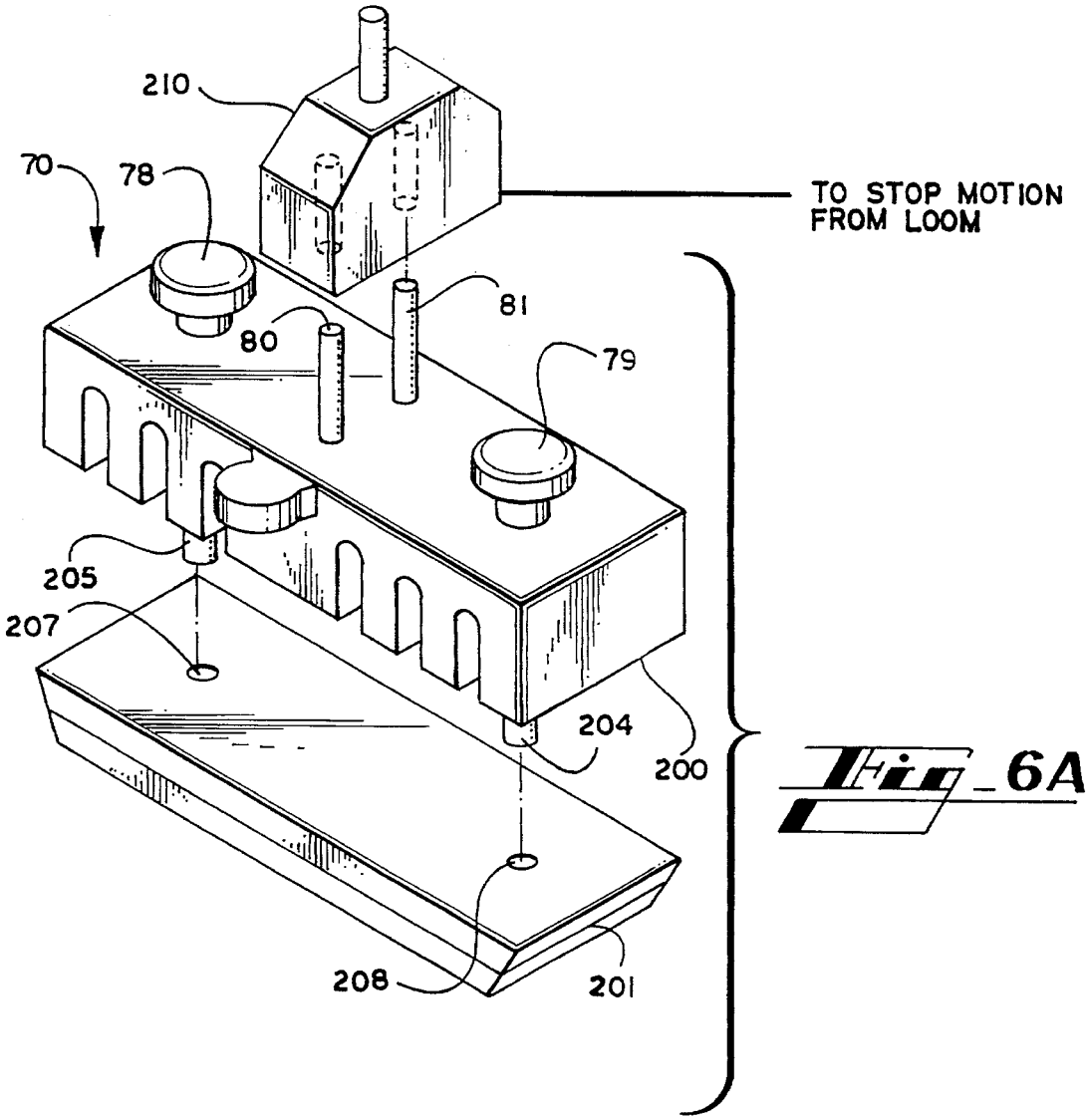
FIG. 6A is a schematic diagram of the connector of the preferred embodiment of the present invention.
Figure 6B:
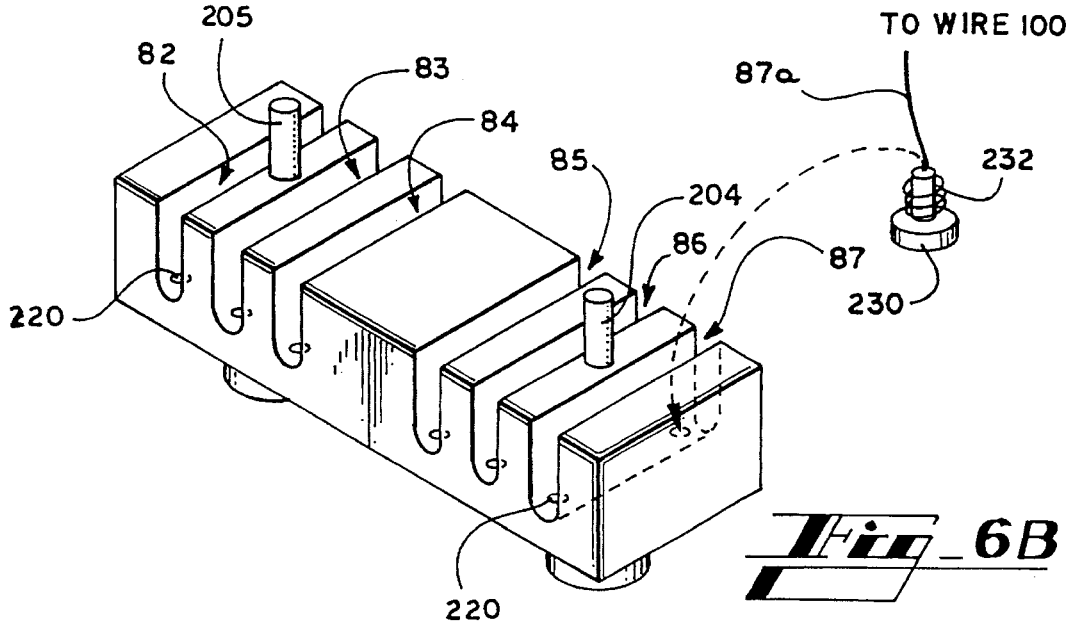
FIG. 6B is a schematic drawing showing the underside of the connector of the preferred embodiment.

FIGS. 6A and 6B show the connector and the pushbutton test connector provided with the loom stop device. Referring to FIG. 6A, the connector 70 contains two posts 80 and 81. Post 81 is connected by a wire 81*a* to the display 72. The connector includes a bottom portion 200 from which threaded members 204 and 205 project to engage a retaining member 201. Member 201 includes two threaded openings 207 and 208 configured for receipt of the posts 204 and 205. In this manner, the connector 70 is secured by means of the knobs 78 and 79. The pushbutton test connector 210 is configured for receipt by the posts 80 and 81. The connector 70 includes spring-loaded contacts 230 which are secured so that a contact projects from the plurality of openings 220 defined in the top of the slots 82–87. A spring 232 is wrapped about a portion of the contact 230 so as to provide tension thereto. It will be understood by those of ordinary skill that the contact projects into the slot 82-87 a sufficient distance to engage the warp bars 32–37, respectively. The position of the contacts 230 may be altered depending on the configuration of the warp bars 32–37. The contacts 230*a*–230*f* each engage an upper metal plate (Not Shown) that contacts, in turn, the warp bars 32–37 by means of the contacts 230*a*–230*f*. The top plate of the connector 70 rests above the upper metal plate. The springs 232 rest against the upper metal plate in order to impart tension to the contacts 230*a*–230*f*. The contacts 230*a*'–230*f*' are electrically connected to wires 82*a*, 83*a*, 84*a*, 85*a*, 86*a* and 87*a* which are in turn connected to the display 72 as described.

FIG. 5 shows a circuit diagram of the present invention. The warp bars 32–37 are connected to and switchably drive the gates of a plurality of silicon controlled rectifiers (SCRs) 162–167 respectively. 12 volts is delivered to terminal 80 from the loom 11. The warp bars 32–37 are thus electrified, in parallel, as described hereinabove, between the terminal 80 and the second terminal 81. The circuitry of the present invention further provides a current delivered from a power source such as battery 153. The power source may be either a direct current source or an alternating current source 122 utilizing a rectifier (not shown). Battery 153 is connected to a normally closed reset switch 150 that connects two contact points 157 and 158. The plurality of indicator lights are connected in parallel. Each indicator light is, in turn, connected in series with one of SCRs 162–167.

The circuits controlling each of lamps 112–117 are identical. Therefore, the operation is described in connection with the circuit for activating lamp 112. Initially, when the loom is in operation, no current flows through lamp 112 and contact 132 is isolated from contact 142 because no drop wire establishes a connection through the conductors of warp bar 32. When a drop wire 40 shorts the contacts of warp bar 32, contacts 230*a* and 230*a*' become closed, completing the circuit between positive terminal 80 and gate resistor 172. This injects sufficient current into the gate terminal of SCR 162 to cause the SCR to fire in response to its cathode to anode voltage. When the SCR fires, current flows through lamp 112.

Once SCR 162 fires, it will remain in a conducting state until the anode to cathode current falls below a relatively low value that is characteristic of the particular SCR, known as the holding current. Therefore, lamp 112 will remain illuminated, even if the loom is restarted and drop wire 40 no longer bridges the contacts of warp bar 32 since the SCR is latched in an on condition. The resistance of lamp 112 is selected to assure that the current through the lamp and SCR 162 is higher than the holding current. This condition maintains until operation of reset switch 120, which opens the connection between terminals 157 and 158. The opening of the circuit extinguishes current flow through SCR 162 and the SCR switches to its off condition, and will remain in same unless re-triggered by another pulse of current into the gate circuit, as described hereinabove.

In the preferred embodiment, gate resistor 172 is 60K ohms and resistor 182 is on the order of 2K ohms. Thus, resistor 182 shunts most current away from the gate junction, thereby helping to protect same from punch through.

While this invention has been described in detail with particular reference to preferred embodiments thereof, it will be understood that variations and modifications can be effected within the spirit and scope of the invention as described hereinbefore and as defined in the appended claims.

I claim:

1. A false warp stop diagnostic device for use with an industrial loom having at least one electrically conducting warp bar and a plurality of drop wires associated therewith, comprising:

a connector comprising a housing that defines at least one channel configured for receipt of at least one warp bar of the loom;

a source of electrical energy for establishing a current in a circuit;

at least one indicator device connected in parallel with said electrical energy source; and a rectifier connected in series with each of said indicator devices, whereby when one of the drop wires contacts a warp bar on the loom, the gate of the rectifier associated with said warp bar is fired and said circuit is completed including one of said indicator devices such that said indicator device is activated and remains activated even after the loom is restarted.

2. The false warp stop diagnostic device of claim 1 further comprising a reset switch connected in series with said at least one indicator device and said rectifier such that said activated indicator device will remain activated until said reset switch is operated.

3. An improved industrial loom, comprising:

a plurality of longitudinally extending warp threads;

at least one electrically conducting warp bar that extends substantially perpendicular to said plurality of longitudinally extending warp threads;

at least one drop wire associated with said electrically conducting warp bar so as to form a circuit, each said drop wire being threaded upon one of said longitudinally extending warp threads such that, by means of the tension in said warp thread, said drop wire is maintained in an inoperative, elevated position above said electrically conducting warp bar;

a connector comprising a housing that defines at least one channel configured for receipt of said electrically conducting warp bar;

a source of electrical energy for establishing a current in said circuit;

* * * * *